US006413128B2

(12) United States Patent
Brabeck

(10) Patent No.: US 6,413,128 B2
(45) Date of Patent: Jul. 2, 2002

(54) DEVICE FOR CHANGING THE DIRECTION OF TRAVEL OF A WATERCRAFT

(75) Inventor: Stephan Brabeck, Boppard (DE)

(73) Assignee: Schottel GmbH & Co. KG, Spay (DE)

( * ) Notice: Subject to any disclaimer, the term of this patent is extended or adjusted under 35 U.S.C. 154(b) by 0 days.

(21) Appl. No.: 09/734,638

(22) Filed: Dec. 12, 2000

(30) Foreign Application Priority Data

Dec. 15, 1999 (DE) ..... 199 60 577

(51) Int. Cl.[7] ..... B63H 1/18
(52) U.S. Cl. ..... 440/66; 114/114 R
(58) Field of Search ..... 140/66; 114/144 R, 114/146, 150, 151, 162

(56) References Cited

U.S. PATENT DOCUMENTS

| | | | | | |
|---|---|---|---|---|---|
| 3,118,639 | A | * | 1/1964 | Kiceniuk | 114/162 |
| 4,470,364 | A | * | 9/1984 | Kitaura et al. | 114/151 |
| 5,090,352 | A | * | 2/1992 | Stanford | 114/162 |
| 5,114,104 | A | * | 5/1992 | Cincotta et al. | 114/162 |
| 5,687,670 | A | * | 11/1997 | Rice, IV | 114/151 |
| 5,727,381 | A | * | 3/1998 | Rogers | 114/151 |

* cited by examiner

*Primary Examiner*—Stephen Avila
(74) *Attorney, Agent, or Firm*—Levine & Mandelbaum

(57) ABSTRACT

The present invention pertains to a device for changing the direction of travel of a watercraft with a drive with a gondola-like underwater housing 2 having a contour favorable in terms of flow outside the hull 1 of the watercraft, past which water flows and which is connected to the hull 1 of the watercraft by a shaft 3, one end of which is associated with the underwater housing and the other end of which is associated with the hull 1 of the watercraft. A drive shaft 7, which carries at least one propeller 6 outside the underwater housing, is led out of at least one end of the gondola-like underwater housing 2. The change in the direction of travel of the watercraft 1 is brought about by the shaft 3 being mounted at its upper end pivotably on the watercraft 1 and by a pivoting motor 24 (toothed ring 20, motor pinion 21) acting on the shaft. In addition or as an alternative to this possibility of pivoting, the direction of travel of the watercraft may be changed by the fact that means which act on the water flowing past the underwater housing to thus change the direction of travel of the watercraft are associated with the gondola-like underwater housing 2 and/or the shaft. The means may be high-energy fluid jets 22 which are discharged from nozzles 8, 9 and act directly on the flowing water or change the contour of a shell 23, which surrounds the gondola-like underwater housing 2 and/or the shaft 3. To change the contour, the shell consists, e.g., of an elastically deformable material.

5 Claims, 1 Drawing Sheet

DEVICE FOR CHANGING THE DIRECTION OF TRAVEL OF A WATERCRAFT

BACKGROUND OF THE INVENTION

The present invention pertains to a device with which a steering power can be generated for course correction at velocities greater than zero in the case of azimuthal drive systems, e.g., poded drive or azimuth thrusters, without the drive having to be pivoted. More specifically, the present invention pertains to a ship drive unit which has an underwater housing in which an essentially horizontally arranged propeller shaft is mounted, on which propellers are arranged in front and/or in the rear. The housing is connected to the hull via a shaft having a shape favorable in terms of flow. The connection to the ship may be designed such that the shaft and the gondola and consequently also the propeller or propellers can be pivoted around an essentially vertical axis (azimuth propulsor). However, it is also possible to design this connection as a rigid connection.

SUMMARY OF THE INVENTION

Devices which permit the flow past the shaft to be affected such that a transverse force is generated on the shaft, which transverse force leads to a change in course at a forward velocity of the ship without the shaft being pivoted like a rudder, are arranged according to the present invention in the area of the shaft. This is independent of whether the drive unit of the ship is installed rigidly in the ship or whether the pivotable unit is fixed in the forward direction.

This type of course correction is advantageous in azimuthally steerable drive systems when a noise-sensitive arrangement is involved, e.g., in ships used for military purpose or ships with a high demand in terms of comfort, such as cruise ships. A pivoting movement of the drive leads to an oblique flow to the propeller or propellers in these ships, as a consequence of which the cavitation occurring as a result generates intense noise in the water and the ship. By affecting the flow in the area of the shaft, the course correction of the ship can be achieved without a pivoting movement of the drive, so that an increased sound and vibration level cannot be observed.

Similar advantages can also be seen in the case of gondola drives installed permanently in ships because the rudder necessary here can be made smaller or eliminated altogether.

In the practical application of the present invention, various devices are conceivable by means of which the flow past the shaft and consequently the course of the ship can be affected.

These devices may comprise nozzles, which are arranged at certain points of the shaft section, from which water exits, by which the flow past the shaft section is in turn changed such that steering forces are exerted on the ship. Another possibility, with a similar effect, is the drawing off of water at correspondingly selected points of the shaft.

Affecting the flow by electromagnetic effects is also conceivable.

It would also be possible to change the flow past the shaft by means of parts of a flexible design of an outer hull, so that a transverse force is generated.

An arrangement of a rotating cylinder according to the known principle of the Flettner rotor is also conceivable.

DESCRIPTION OF THE DRAWINGS

The drawing may facilitate the understanding of the present invention; in these schematic and exemplary drawings.

DESCRIPTION OF THE PREFERRED EMBODIMENT

Figure 1:
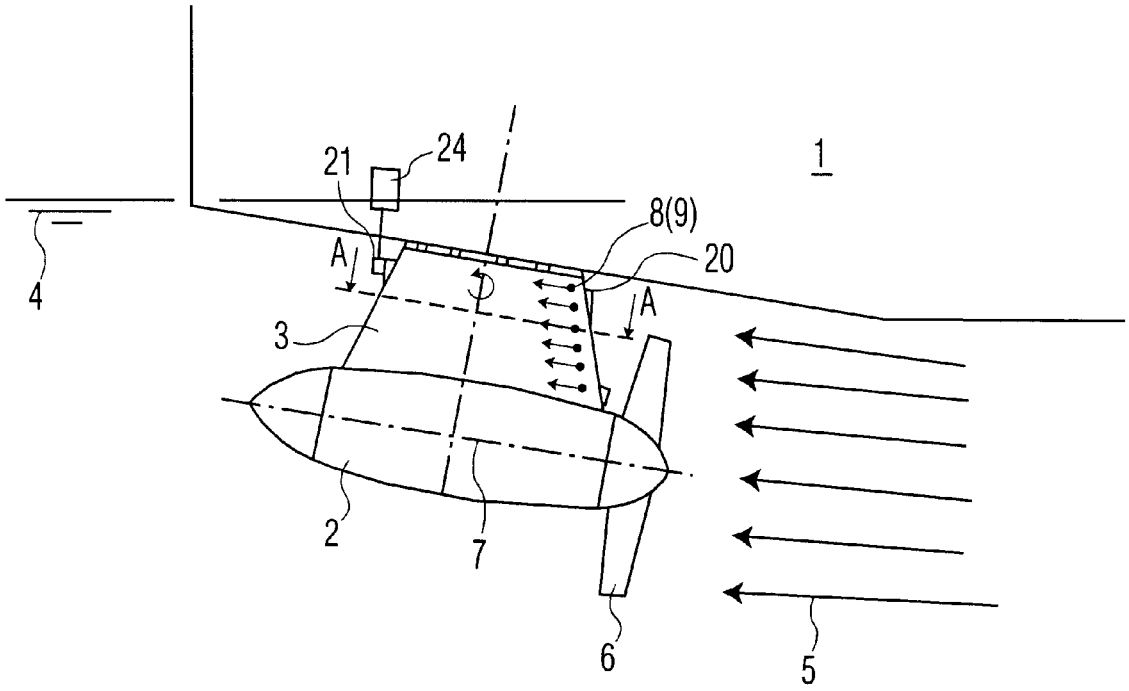
FIG. 1 shows the side view of a drive designed according to the present invention and FIG. 2 shows a section along line A—A in FIG. 1.
Figure 2:
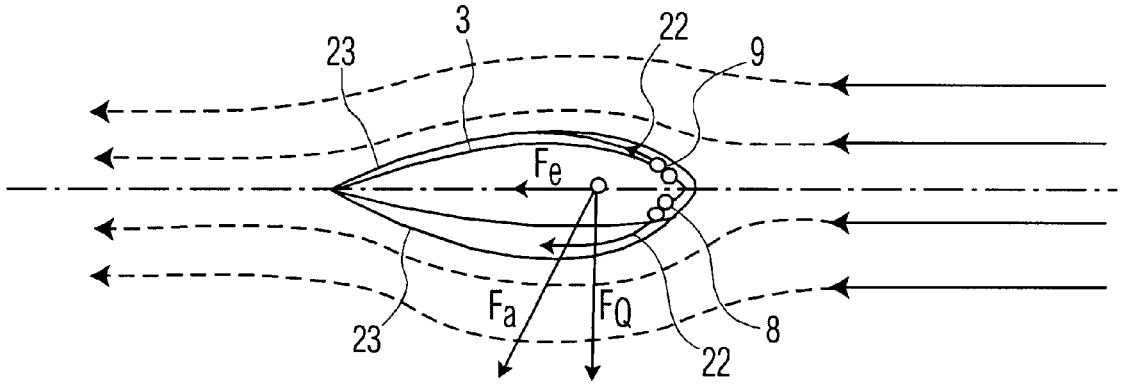

A gondola-like underwater housing 2, which encloses a shaft 3 for mounting on the watercraft 1, is arranged under the stern of a watercraft 1, the shaft being consequently connected to the underwater housing 2 at its lower and to the hull of the watercraft at its upper end, the length of the shaft 3 being selected to be such that the underwater housing is located under the water surface 4 so much that water flows past it on all sides with the watercraft moving, wherein arrows 5 symbolize the laminar flow against the underwater housing 2 and wherein the shaft length is also selected to be such that the ship propeller 6 can freely rotate at one end of the underwater housing under the hull of the watercraft around a horizontal axis which is the longitudinal axis 7 of the underwater housing in order to bring about the propulsion of the watercraft. The ship propeller 6 is associated, rotating in unison, with the power take-off shaft of a power generator, which may be essentially an electric motor or an internal combustion engine, with which a transmission may be associated and which may be arranged completely in the underwater housing, especially in the case of an electric motor, but it may also be arranged in the watercraft and connected to the power take-off shaft in a power-transmitting manner.

In case of a corresponding design, the propeller 6 may be arranged at the other end of the underwater housing 2, or a propeller each may be arranged at each end of the underwater housing 2, the propeller being driven by a common power generator or by separate power generators; instead of the one propeller 6 being shown, a plurality of propellers may also be arranged at the end or at each end of the underwater housing, but this is not essential for the present invention.

What is essential for the present invention is that a plurality of openings 8, 9 are associated with each of the two sides of the shaft 3, which has a drop-shaped or hydrofoil-shaped cross section. A plurality of respective openings 8 and 9 following each other in an approximately vertical direction form a straight row on each side. They may be nozzle-like fluid discharge openings, through which a high-energy fluid is discharged from the shaft, to which it had been fed in a suitable manner, into the surrounding water in order to bring about a steering effect when it is discharged from the shaft on one side of the shaft or the other in order to affect the flow 5 of the surrounding water with a corresponding intrinsic energy. The fluid acting on the flow 5 may be a gaseous or preferably liquid fluid; it is preferably water which has been taken from the surrounding water in a suitable manner and whose energy level has been raised. A corresponding effect can also be achieved in a different way when water is drawn into the shaft 3 through the openings 8 or 9 instead of introducing a fluid into the water flow. If nozzles are used, these may be adjustable and they may be designed or mounted with variable direction of discharge.

If used alone, the device being described may be used to affect the direction of travel of the watercraft, in which case the shaft 3 is permanently associated at both ends with the hull of the watercraft and with the underwater housing. However, the device according to the present invention may also be used in conjunction with a rudder propeller unit, in which the shaft 3 is mounted at its upper end pivotably or rotatably on the hull of the watercraft, so that the direction of travel of the watercraft can be changed by adjusting the propeller or by changing the direction of delivery of the propeller. The solution according to the present invention now has a supportive effect or it has an alternative effect if the change in the direction of travel of the watercraft is to be take place with as little noise as possible, as was explained in the introduction.

As an alternative to these solutions, the shaft may be surrounded by a flexible shell, between which and the shaft two chamber-like spaces are present, into which pressurized fluid can be alternatingly admitted from the shaft, so that the contour swept by the flow is changed asymmetrically, by which a steering effect can also be generated for the watercraft.

In summary, the present invention can be described essentially as follows.

The present invention pertains to a device for changing the direction of travel of a watercraft with a drive with a gondola-like underwater housing 2 having a favorable contour in terms of flow outside the hull 1 of the watercraft, which is flown past by the water and which is connected to the hull 1 of the watercraft by a shaft 3, one end of which is associated with the underwater housing and the other end of which is associated with the hull 1 of the watercraft. A drive shaft 7, which is mounted in the underwater housing and which carries at least one propeller 6 outside the underwater housing, is led out of at least one end of the gondola-like underwater housing 2. The change in the direction of travel of the watercraft 1 is brought about by the shaft 3 being mounted at its upper end pivotably on the watercraft 1 and by a pivoting motor 24 (toothed ring 20, motor pinion 21) acting on the shaft. In addition or as an alternative to this possibility of pivoting, the direction of travel of the watercraft may be changed by the fact that means which act on the water flowing past the underwater housing are associated with the gondola-like underwater housing 2 and/or with the shaft in order to thus change the direction of travel of the watercraft. The means may be high-energy fluid jets 22 which are discharged from the nozzles 8, 9 and act directly on the water flowing past or change the contour of a shell 23, which surrounds the gondola-like underwater housing 2 and/or the shaft 3. To change the contour, the shell consists, e.g., of an elastically deformable material.

What is claimed is:

1. Device for changing the direction of travel of a watercraft having a drive with a gondola-like underwater housing, said housing having a contour about which water flows during travel of the watercraft, a housing support shaft one end of which is connected to the underwater housing and the other end of which is connected to the hull of the watercraft, said underwater housing being rotable relative to said hull, a drive shaft rotatably mounted in the underwater housing and extending from at least one end of the underwater housing, at least one propeller mounted on the drive shaft outside the underwater housing, flow influencing means mounted on at least one of said housing support shaft and said housing which when actuated changes the direction of travel of said watercraft without a change in the position of said underwater housing by acting on the water flowing about the underwater housing, whereby a change in the direction of travel of said watercraft can be brought about by rotating said housing relative to said hull and/or by actuating said flow influencing means.

2. Device in accordance with claim 1, wherein at least one of the underwater housing and the housing support shaft is surrounded by a shell of deformable contour which contour can be changed by fluid flowing between the shell and the underwater housing and/or housing support shaft.

3. Device in accordance with claim 1, wherein said housing support shaft has an approximately drop-shaped or hydrofoil-shaped cross section, and there are flow influencing means on both sides of a center line of the section, said flow influencing means being able to be actuated independently of one another.

4. Device in accordance with claim 1, wherein said flow influencing means comprises at least one water discharge nozzle.

5. Device in accordance with claim 1, wherein said flow in fluencing means comprises at least one suction nozzle for diverting a portion of the water flowing past the underwater housing.

* * * * *